United States Patent [19]

Abernathy et al.

[11] 4,371,038

[45] Feb. 1, 1983

[54] APPARATUS AND METHOD FOR INJECTING FLUID INTO A WELL

[75] Inventors: William L. Abernathy, Lafayette, La.; Billy B. Bertram, Plano, Tex.; Anthony D. Davis, Carrollton, Tex.; Richard M. Ward, Arlington, Tex.

[73] Assignees: Otis Engineering Corporation, Dallas; Exxon Production Research Company, Houston, both of Tex.

[21] Appl. No.: 213,896

[22] Filed: Dec. 8, 1980

[51] Int. Cl.[3] ..... E21B 33/129; E21B 34/14; E21B 41/02; E21B 43/12

[52] U.S. Cl. ..... 166/380; 166/244 C; 166/316; 166/381; 166/386; 166/387

[58] Field of Search ..... 166/378, 381, 386, 387, 166/117.5, 313, 75 A

[56] References Cited

U.S. PATENT DOCUMENTS

| | | | |
|---|---|---|---|
| 3,115,185 | 12/1963 | Brown | 166/313 X |
| 3,842,912 | 10/1974 | Lindsey, Jr. | 166/313 X |
| 3,993,129 | 11/1976 | Watkins | 166/319 |
| 4,031,955 | 6/1977 | Ledet | 166/117.5 X |
| 4,290,484 | 9/1981 | Beall et al. | 166/387 X |

*Primary Examiner*—Stephen J. Novosad

*Attorney, Agent, or Firm*—H. Mathews Garland; Peter J. Murphy

[57] ABSTRACT

An injection assembly includes a packer set in the casing adjacent to the producing zone, having a bore sized to receive production tubing. A portion of the assembly suspended from the string of production tubing includes a side pocket mandrel, a twin flow head, an extensible telescoping housing, and coacting joint means on the extensible housing and the packer for axial joining of these members. The side pocket mandrel, twin flow head, and twin flow converter provide a first passage joined to the production tubing; and a length of inner tubing joined to the twin flow converter extends this passage down into the bore of the packer. These members provide a second passage beginning at the side pocket mandrel and opening to the annulus between the casing and the string of production tubing, and extending downward to the packer through the annulus between the inner tubing and the surrounding structure, which surrounding structure includes the outer housing of the twin flow converter, the extensible housing, the joint, and the packer mandrel. After joining to the packer the upper portion of the assembly is raised to extend the extensible housing and to raise the lower end of the inner tubing from its lower limiting position within the packer. An injection method, which may be practiced with the above described assembly, is also described.

27 Claims, 15 Drawing Figures

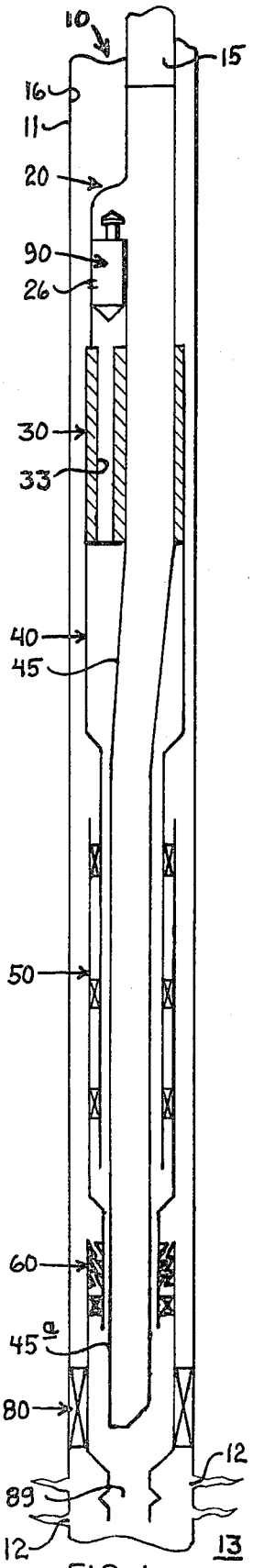
FIG. 1
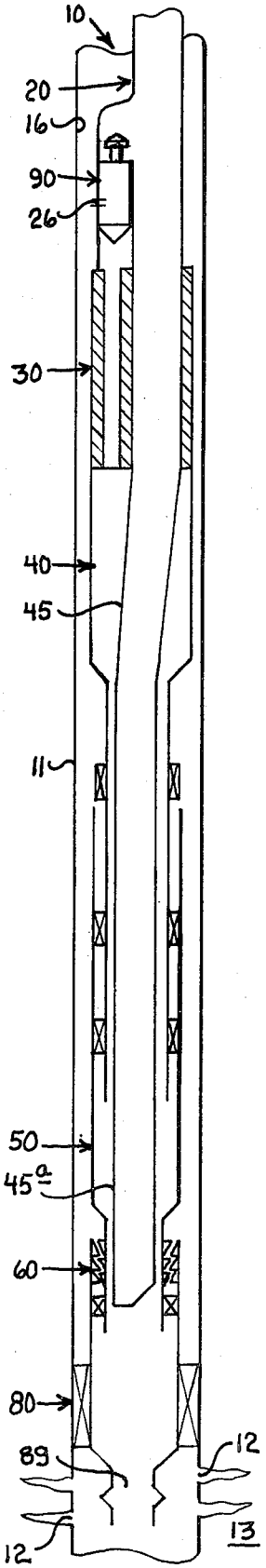
FIG. 2
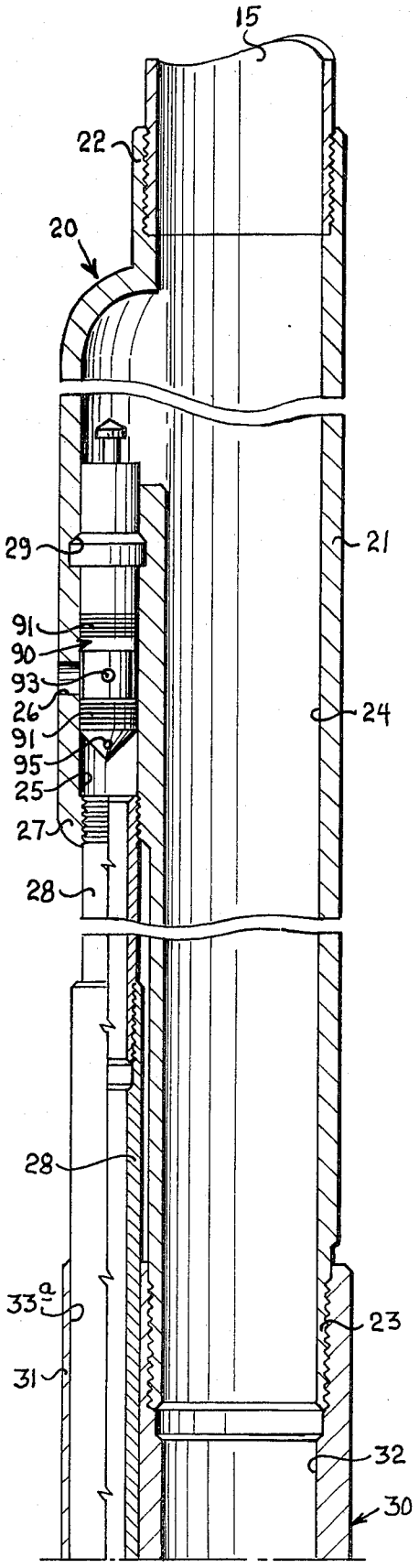
FIG. 3-A

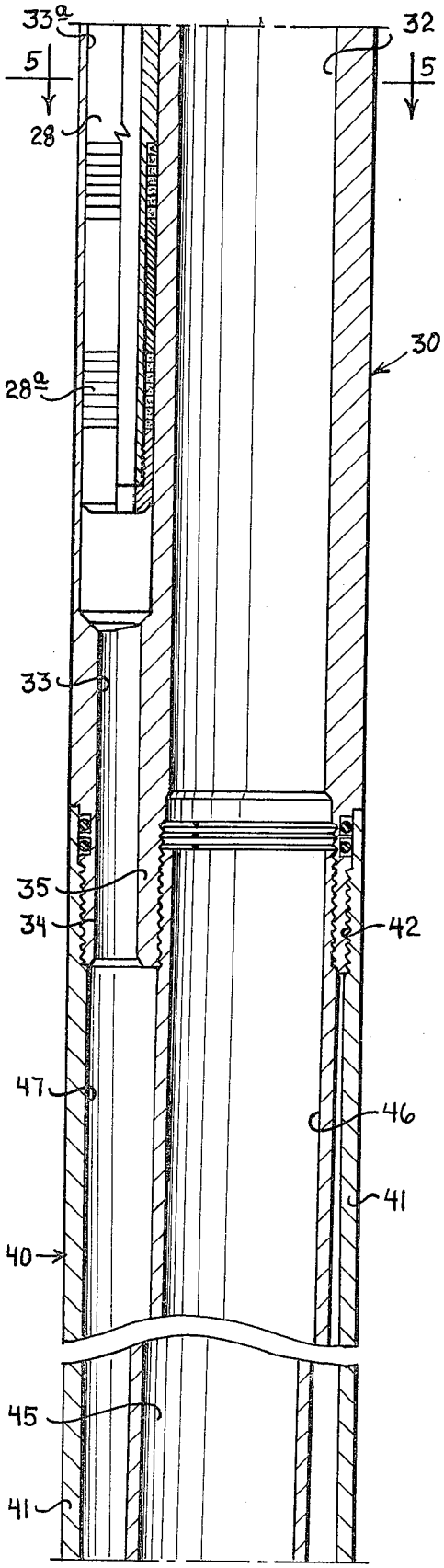
FIG. 3-B
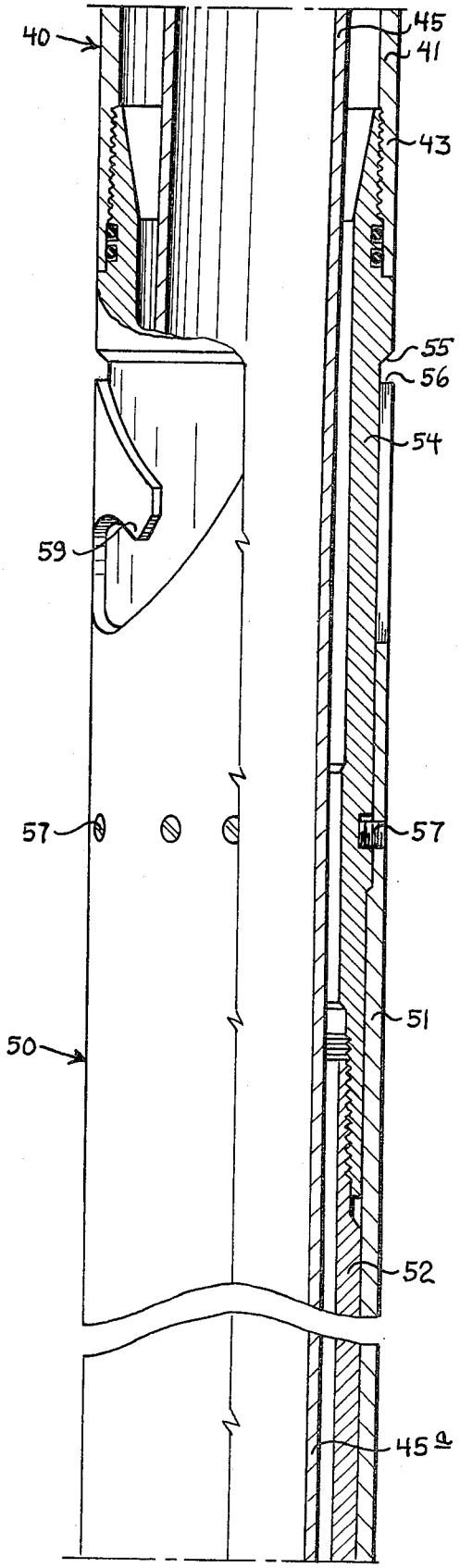
FIG. 3-C

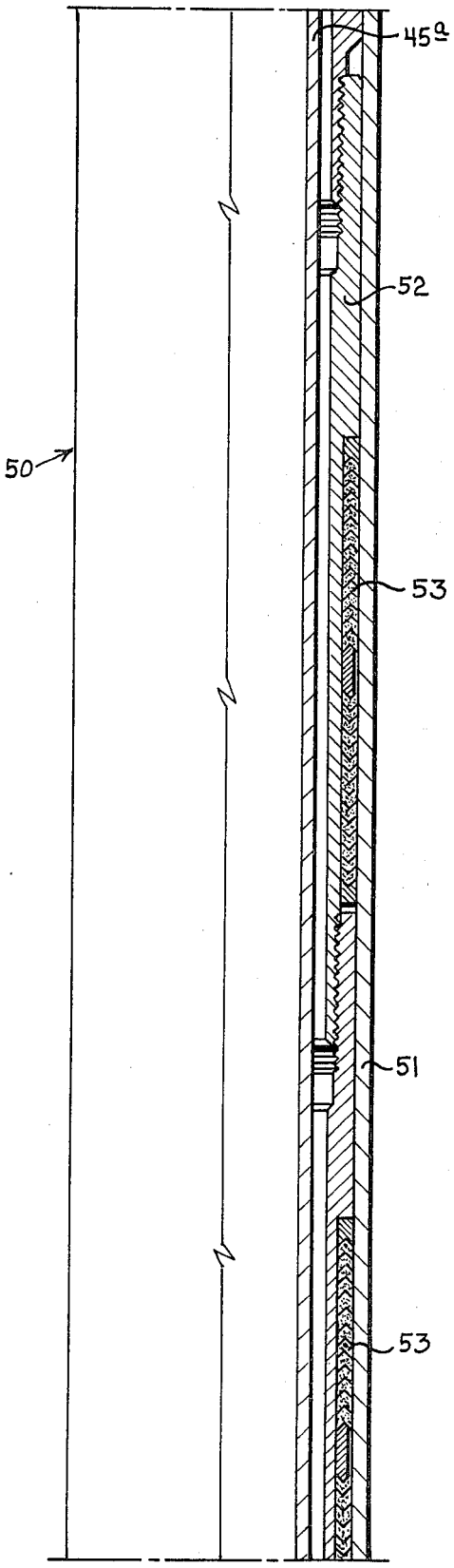
FIG.3-D
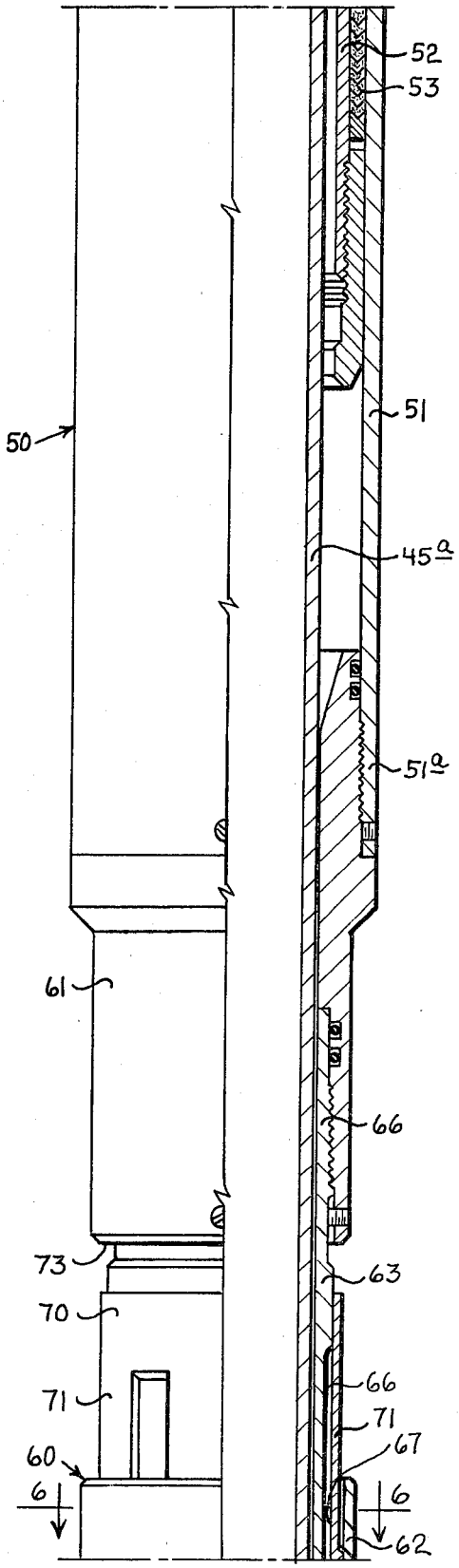
FIG.3-E

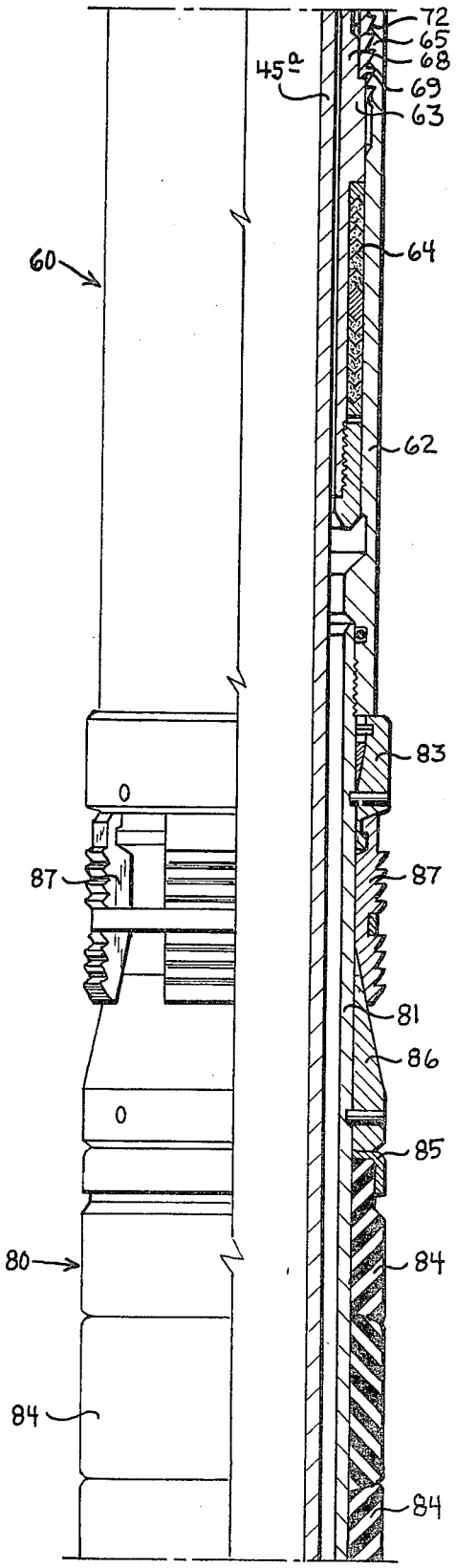
FIG.3-F
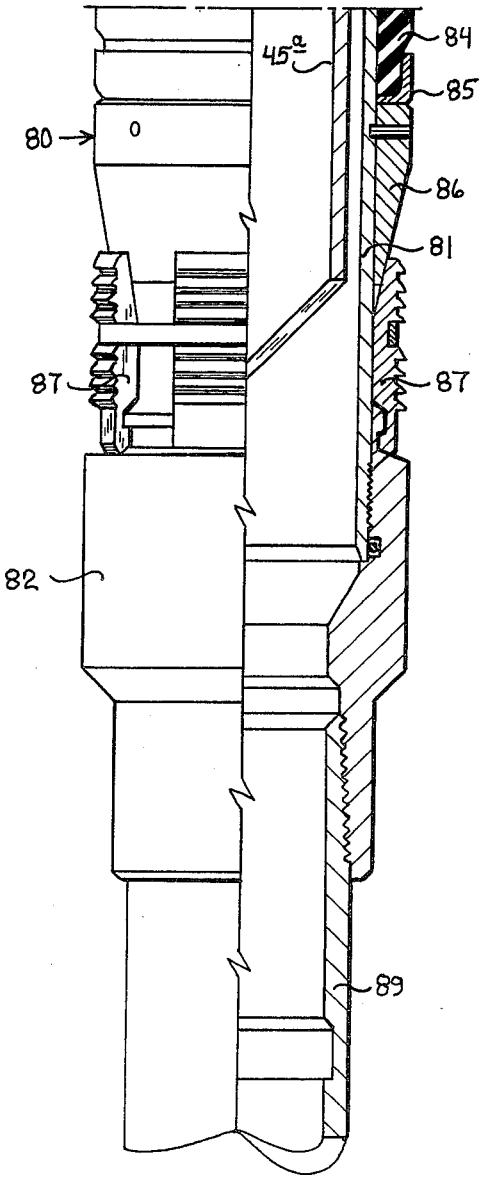
FIG.3-G

APPARATUS AND METHOD FOR INJECTING FLUID INTO A WELL

This invention relates to apparatus and methods for enabling the injection of fluids, such as chemicals, to a point very close to the producing zone of a well.

In many producing oil wells, the production fluid contains very corrosive constituents such as hydrogen sulfide and carbon dioxide which, if not controlled, shorten very drastically the lives of the production tubing and other in-hole components of a well completion package. One way to reduce the effect of this problem is to use tubing and other components which have been particularly designed in a manner to resist the effect of corrosion. They may be fabricated from corrosion-resistant materials, or they may be treated metallurgically to resist corrosion, or they may be simply built of heavier materials to resist the effects of corrosion for a longer time. Often, such specially designed components are more expensive. Another way to attack the problem is to inject into the well, corrosion-inhibiting chemicals to protect the component surfaces outside of the production passage, and to mix with the production fluid to protect the bore of the production tubing. For this to be most effective, the inhibiting chemicals must be injected as close as possible to the bottom of the well, preferably to the bottom of the packer, to prolong the life of the packer as well as the other components. Similarly, it is sometimes necessary to treat wells with chemicals which will prevent or inhibit the formation of scales, the deposit of materials, and the like on the walls of the tubing or casing.

A principal object of this invention is to provide a method and apparatus to enable the injection of chemicals or other fluids to a point very close to the producing zone of a well.

A more particular object of this invention is to provide a method and apparatus to enable the injection of chemicals or other fluids to a point very close to the bottom of the packer which is set in the well casing adjacent to the producing zone.

Another object of this invention is to provide a method and apparatus for such injection of chemicals which is very effective while allowing for expansion and contraction of the tubing string due to temperature changes of the production fluid.

Still another object of this invention is to provide a method and apparatus for enabling the injection of chemicals to a point within the packer, and also enabling the ready removal from the well of the components above the packer, for purposes of repair and replacement for example.

A still further object of this invention is to provide an apparatus to enable the injection of chemical fluids to a point within the packer, including a seal bore converter with an enlarged bore to enable the passing of a larger size production tubing into the packer.

These objects are accomplished in apparatus including a packer to be set in the casing adjacent to the well producing zone and an assembly, a portion of which is suspended from the string of production tubing and a portion of which is supported by the packer. The assembly includes twin-flow means to be joined to the lower end of the string of production tubing, and providing a first passage communicating with that tubing and a second passage communicating with a source of injection fluid. The twin-flow means includes, at its lower end, an inner tubing and an enclosing tubular housing; with the inner tubing defining a continuation of the first passage and the annulus between the outer housing and inner tubing defining a continuation of the second passage. An extensible tubular housing means is joined at its upper end to the tubular housing of the twin-flow means; and a joint means joins the lower end of the extensible housing means to the upper end of the packer. A length of inner tubing is joined to the inner tubing of the twin-flow means, and is of a length to extend into the packer adjacent to its lower end, when the extensible housing means is in its retracted condition. The inner tubing defines an extension of the first passage for passing fluid from the producing zone; and the annulus between the inner tubing and the enclosing structure defines an extension of the second passage to pass injection fluid to the lower end of the inner tubing.

A method for accomplishing these objects includes the steps: setting, in the casing, a packer having an internal passage of sufficient size to pass production tubing with an annular flow space therebetween; suspending, from the lower end of the production tubing, an assembly including a twin-flow means, an extensible tubular housing means, joint means for joining the lower end of said extensible housing means to the packer, and a length of inner tubing; providing, in the twin-flow means, a first passage communicating with the string of production tubing and a second passage communicating with a source of injection fluid, with the lower end of the first passage terminating in an inner tubing and the lower end of the second passage terminating in the annulus between the inner tubing and an outer housing; providing the extensible housing with releasable means for maintaining the housing in a retracted condition; suspending a length of inner tubing from the inner tubing of said twin-flow means to extend through the extensible housing means, the joint means, and the packer to a point adjacent to the bottom thereof, when the extensible housing means is in the retracted condition; whereby the inner tubing provides an extension of the first passage for passing production fluid from the producing zone; and whereby the annulus between the inner tubing and the enclosing structure provides an extension of the second passage for passing injection fluid from the annulus between the casing and said string of production tubing to the lower end of the inner tubing.

The novel features and the advantages of the invention, as well as additional objects thereof, will be understood more fully from the following description when read in connection with the accompanying drawings.

DRAWINGS

FIG. 1 is a diagrammatic illustration of an assembly, according to the invention, during installation when the upper portion of the assembly has just been joined to the packer;

FIG. 2 is a diagrammatic illustration similar to FIG. 1, wherein the upper portion of the assembly has been raised relative to the packer;

Figure 4:
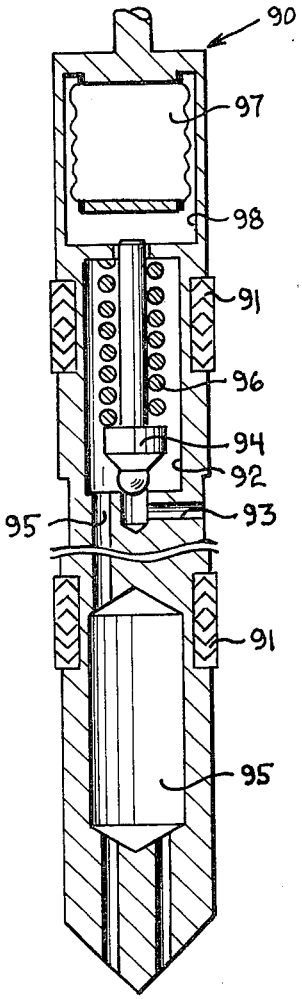
Figure 5:
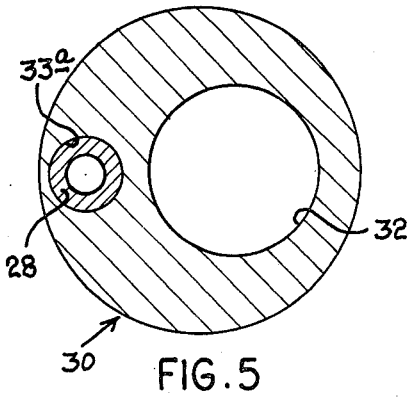
Figure 6:
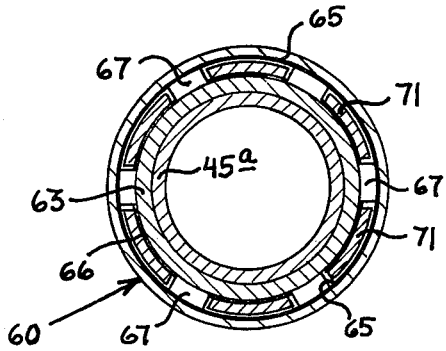
Figure 7:
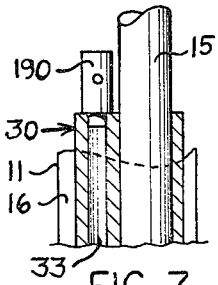
Figure 8:
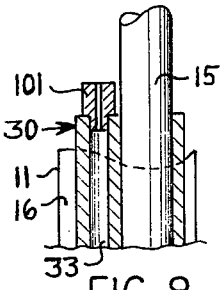
Figure 9:
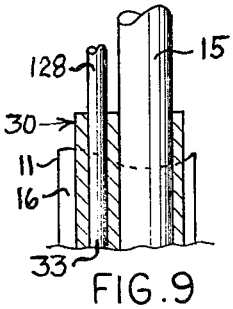

FIGS. 3-A through 3-G are sequential sectional and/or elevation views of the assembly illustrated in FIG. 1, showing details of the several components;

FIG. 4 is a detailed sectional view of the valve shown in FIG. 3-A;

FIGS. 5 and 6 are sectional views taken along the lines 5—5 and 6—6 of FIGS. 3-B and 3-E, respectively; and FIGS. 7, 8, and 9 are fragmentary diagrammatic views illustrating alternative embodiments of the invention.

DESCRIPTION OF THE PREFERRED EMBODIMENT

Referring particularly to FIG. 1 of the drawing, a completion assembly according to the invention is shown diagrammatically within a well 10 having a casing 11 which is perforated at 12 to permit fluids to flow into the well from a producing zone 13 of the formation. The casing extends to the wellhead, which includes means for supporting a string of production tubing 15, from which is suspended a portion of the completion assembly to be described. The remaining and lower portion of the assembly includes, and is supported by, a packer 80 which is set in the casing just above the producing zone 13. This assembly provides both a production passage extending therethrough and an injection passage to the lower end of the packer 80. Injection fluid will flow downward from the wellhead to this assembly through the annulus 16 between the casing and the tubing string.

The basic components of the assembly, as aligned within the well casing from top to bottom, are: a side pocket mandrel 20 joined to the lower end of the tubing string 15, wherein the side pocket provides the upper end of the injection passage, which upper end opens to the annulus between the tubing 15 and the well casing 11, and including an injection valve 90 in the injection passage; a twin flow head 30 joined to the lower end of the side pocket mandrel and providing side-by-side production and injection passages; a twin flow converter 40 connected to the lower end of the twin flow head 30 for converting the side-by-side passages to concentric or eccentric passages; a seal bore converter 50 connected to the lower end of the twin flow converter housing, being extra large to allow passage of inner production tubing of enlarged size; a latching and sealing joint 60 having an inner packing mandrel joined to the lower end of the seal bore converter and having an outer seal housing joined to the upper end of the packer 80.

Referring now particularly to FIG. 3-A, the side pocket mandrel includes a housing 21 having an upper threaded box 22 and an aligned lower threaded pin 23, defining a first main passage 24 for the production fluid. The box 22 is threadedly joined to the lower end of the tubing string 15 to supprt certain portions of the assembly as will be described. The housing 21 provides a side pocket, including a receptacle 25 which functions as the upper end of an injection passage extending through the assembly. This receptacle includes a lateral port 26 for communicating the receptacle with the annulus 16, and a lower threaded box 27 to receive the upper end of an extension tube 28 in threaded relation. The extension tube carries external annular packings 28*a* adjacent to its lower end. The receptacle 25 is provided with a locking recess 29 for anchoring an injection valve 90, to be described in detail subsequently.

Referring particularly to FIGS. 3-A and 3-B, the twin flow head 30 consists of a housing 31 defining first and second side-by-side passages 32 and 33. The first passage 32 is the production passage and terminates, at its upper end, in a threaded box which is threadedly connected to the threaded pin 23 of the side pocket mandrel. The housing 31 includes, at its lower end, an external threaded pin 34, and an internal threaded box 35 for the production passage 32. The second passage 33 is the injection passage, and includes an upper polished bore 33*a* for receiving the lower end of the extension tube 28 and the packings 28*a* in sealing relation therewith. The extension tube is moved upwardly within the polished bore to effect the joining with the receptacle box 27.

The twin flow converter 40 includes an outer housing 41, providing an outer tubing, having a threaded box 42 at its upper end for threaded engagement with the threaded pin 34, and having a threaded box 43 at its lower end. This converter includes an inner tubing 45 having a threaded pin at its upper end for threaded engagement with the box 35, and by means of which the inner tubing 45 is suspended. This tubing 45 is the upper end of a string of production tubing, including tubing 45*a* extending to the bottom of the assembly, and defines a first passage or production passage 46 through the twin flow converter. The annular space between the housing 41 and the inner tubing 45 defines a second passage 47 through the converter, which communicates with the second passage 33 of the twin flow head.

Referring particularly to FIGS. 3-C, 3-D and 3-E, the seal bore converter 50 includes an outer seal housing 51, having an internal polished bore, and an inner seal mandrel 52 carrying external annular seals or packings 53 for sealing coaction with the polished bore of the housing 51. This seal bore converter may have substantial length, twenty feet for example, and both the housing 51 and seal mandrel 52 are fabricated in sections threaded together to define a continuous housing and continuous mandrel with axially spaced packings 53. A seal mandrel head 54 is joined to the upper end of the seal mandrel 52, and is disposed partially within the housing 51. The head has a radially enlarged portion providing a shoulder 55 which, in operation, may engage the confronting upper end face 56 of the seal housing 51. The upper end of the head is provided with a threaded pin for threaded connection with the lower box 43 of the twin flow converter.

In initial assembly of the seal bore converter 50, the axial relationship of the seal housing 51, on the one hand, and the assembly of the seal mandrel 52 and seal mandrel head 54, on the other hand, is fixed by a plurality of shear pins 57 which are threaded into suitable threaded bores in the seal housing and extend into an annular groove in the seal mandrel head. These shear pins remain intact for the purpose of setting the assembly within the well casing, and are subsequently sheared as will be described to allow relative axial movement of the seal housing and the remainder of the converter assembly. The seal housing is provided at its upper end with a J-slot 59 to enable coupling at a later time, for a purpose to be described, with a suitable latching tool to effect rotation and withdrawal of the seal housing. The seal housing includes a threaded box 51*a* at its lower end.

The latching and sealing joint 60 best seen in FIGS. 3-E and 3-F, includes a top sub 61, joined to the lower end of the seal bore converter by means of an upper threaded pin engaging the threaded box 51*a*, and having a lower threaded box. This latching and sealing joint includes an outer housing 62 and an inner mandrel 63 carrying annular seals or packing 64 adjacent to its lower end. The intermediate portion of the housing 62 defines a sealing bore for coaction with the packing 64; and the upper portion of the housing 62 defines a latch receptacle having internal threads 65, such as buttress threads, which are left hand threads for a purpose to be described. A threaded pin 66 is provided at the upper end of the mandrel for threaded engagement with the lower box of the sub 61.

The latching and sealing joint 60 includes a latch sleeve 70 slidably mounted on the mandrel 63 adjacent to its upper end; the latch sleeve including downwardly extending, laterally spaced, flexible fingers 71 which are provided with axially spaced external serrations 72 at the lower end thereof. These serrations 72 define left hand external threads such as buttress threads on the latch sleeve for coaction with the internal threads 65 of the housing 62; and the threads 65 and 72 also define coacting ratchet teeth engageable when the sleeve is moved axially into the housing, and which prevent axial separating movement. The mandrel 63 is provided with an axially extended external annular recess 66, provided to allow the latch sleeve fingers 71 to deflect radially inwardly to allow the ratcheting engagement of these fingers with the threads 65. This finger deflection can occur when the latch sleeve 70 is raised from the position indicated in FIGS. 3-E and 3-F as will be described. The sub 61 provides a shoulder 73 for limiting the upward movement of the latch sleeve relative to the mandrel. The mandrel 63 is provided with circumferentially spaced lugs 67 projecting radially outward from the base of the recess 66; and these lugs extend radially between the fingers 71, during all positions thereof, to prevent relative rotation between the mandrel 63 and the latch sleeve 70. This anti-rotation means is necessary for effecting the unthreading of the threads 65 and 72 when required, as will be described. The mandrel 63 includes a circumferential cam 68, immediately below the recess 66, to lock the finger serrations 72 in engagement with the threads 65; and a shoulder 69 limits the downward movement of the fingers. A suitable latching and sealing joint is the Otis Ratch Latch manufactured by Otis Engineering Corporation, Dallas Tex.

In the latching operation of this latching and sealing joint, the sleeve 70 will normally be disposed in the position illustrated in FIGS. 3-E and 3-F. As the seal mandrel 63 is moving into the housing 62, the lower ends of the fingers will engage the upper end of the outer housing and cause the sleeve to ride upward into engagement with the sub shoulder 73. This will position the finger ends above the cam 68, thereby allowing inward deflection of the fingers; and, with further downward movement of the mandrel and sleeve, the fingers will ratchet into engagement with the housing threads 65. When the portion of the assembly including the mandrel is subsequently raised, the mandrel will rise slightly relative to the latch sleeve 70 to position the cam 68 inside the ends of the fingers and lock the fingers in engagement with the threads.

The packer 80 is of known construction, including an elongated tubular mandrel 81 having threaded pins at its upper and lower ends. The upper pin is threadedly engaged with the lower box of the latching and sealing joint housing 62. A bottom sub 82 is threadedly connected to the lower pin, and includes a lower threaded box. An axially slidable setting collar 83 is axially confined on the mandrel 81, adjacent to the upper pin, by shear pins. Several expandable annular seal rings 84 are disposed around the mandrel 81, between its ends. These seal rings adjoin each other axially and are confined between upper and lower anti-extrusion rings 85. The anti-extrusion rings in turn are confined between upper and lower slip cones 86, both of which are secured axially to the mandrel by means of shear pins. The slip cones coact with respective upper and lower slips 87, the upper slips being engaged by a downward facing shoulder of the setting collar 83, and the lower slips being engaged by an upward facing shoulder of the bottom sub 82. The packer is set in the usual manner by exerting a downward force on the setting collar 83 while restraining downward movement of the mandrel 81; and this causes radial expansion of the seal rings into sealing engagement with the casing, and concurrent locking engagement of the slips with the casing to prevent further axial movement of the packer.

The producing zone of the well is below and adjacent to the packer. A landing nipple 89 is threadedly joined to the lower box of the bottom sub 82, providing means for landing a seal plug to plug the production passage, when desired, to enable repair or replacement of the assembly components above the packer.

In the initial assembly of this completion assembly, the housing and seal mandrel of the seal bore converter 50 are pinned together by the shear pins 57, and the lower end of the seal mandrel is positioned close to the lower end of the housing. The length of the string of inner tubing 45 is determined so that, after initial assembly within the well, the lower end of this tubing 45 is positioned very close to the bottom of the packer 80. The drawings illustrate these relative positions of the assembly components, with the exception of FIG. 2. The setting of this completion assembly will be described subsequently.

Referring now to the injection valve 90, particularly illustrated in FIG. 4, this valve may be like that described in U.S. Pat. No. 3,993,129, issued Nov. 23, 1976, with particular reference to FIG. 4 of that patent. This valve includes a housing received within the receptacle 25 of the side pocket mandrel; and the housing is provided with upper and lower spaced external seals 91 which are disposed within the receptacle above and below the port 26. The housing provides a valve chamber 92 including a lower valve seat which communicates with a passageway 93 opening to the side of the housing; and the passageway 93 communicates with the port 26 of the receptacle. Injection fluid entering the port 26 must then pass into the chamber 92. A valve closure member 94 seats on the valve seat and controls the flow of fluid into the chamber 92; and the fluid entering the chamber 92 passes therefrom through an outlet passageway 95 to the lower end of the valve and into the extension tube 28.

The closure member 94 is yieldably urged to the closed position by a compression spring 96. Therefore, the force acting on the closure member 94 to open the valve is proportional to the fluid pressure in the annulus 16 which includes the fluid injection pressure at the well surface and the hydrostatic head of the fluid in the annulus 16. The forces acting to close the closure member 94 include the spring 96 and the pressure within the chamber 92, which is the back pressure on the injection fluid column in the injection passage exerted by the pressure of the production fluid at the lower end of the injection passage. The injection valve is preset by the spring 96 to a desired opening pressure so as to open and allow flow of injection fluid from the annulus 16 to the injection passage, when the annulus pressure exceeds the injection passage back pressure by a preset amount.

However, in the event that the back pressure in the injection passage should drop excessively, the difference between the pressure in the annulus 16 and the injection passage pressure would increase excessively, thereby increasing undesirably the flow of injection fluid into the injection passage. A closed, pressurized, expansible bellows 97 is mounted within chamber 98 to provide a closure force sufficient to overcome the hydrostatic head in the annulus 16 when the pressure in the injection passage drops below a preselected value. The chamber 98 is exposed to the pressure in the injection passage through the chamber 92. The bellows 97 is supported within the valve housing with its lower end being movably positioned adjacent to the upper end of the valve closure member 94; and the upper end of the bellows is secured against movement, whereby the lower end will move toward and away from the valve closure member as the bellows expands and retracts. The gas pressure in the bellows 97 is preset relative to the normal pressure in the injection passage, so that the lower end thereof is normally positioned out of the path of movement of the closure member, as illustrated in FIG. 4. The spring-loaded closure member may then function normally without interference from the bellows. In the event that the pressure in the injection passage decreases beyond normal, the bellows will expand urging its lower end into engagement with the valve closure member 94 thereby urging the closure member against the valve seat to overcome the hydrostatic head in the annulus 16.

METHOD

The above described apparatus is one form of apparatus which may be used to practice some or all of the following steps. A packer is set into the well casing adjacent to the producing zone; and the lower portion of a latching and sealing joint has previously been attached to the upper end of the packer to enable subsequent joining of the upper portion of an injection assembly to the packer. The packer and associated joint portion have an adequately sized central passage to receive and pass production tubing of adequate size while providing an adequate annular flow passage between the tubing and the packer structure. The remaining portion of an injection assembly is suspended from the lower end of a string of production tubing which is then lowered into the well. This assembly includes a twin flow means, an extensible tubular housing means, the upper portion of the above mentioned joint means for joining this suspended assembly to the packer, and a length of inner tubing. The twin flow means provides a first passage communicating with the string of production tubing from which it is suspended, and a second passage communicating with the annulus between that tubing and the casing; and further provides an inner tubing defining the lower end of the first passage and an outer tubular housing surrounding that tubing with the annulus therebetween defining the lower end of the second passage. The extensible housing means is joined to the housing of the twin flow means, is provided with relatively movable portions for effecting the extension and retraction thereof, and is further provided with releasable means for maintaining the extensible housing in the retracted condition during the lowering of this assembly into the well. The upper portion of the joint means is secured to the lower end of this extensible housing. An additional length of inner tubing is attached to and suspended from the inner tubing of the twin flow means, and is of a length to extend through the extensible housing means, the joint means, and into the packer to a point adjacent to its bottom end, when that extensible housing is in the retracted condition. The suspended portion of the assembly is engaged with the packer by the axial latching of the portions of the joint means which provides a sealed joint.

The lower portion of the extensible means is now rigidly joined to the packer; and the tubing string is then raised to effect release of the releasable means of the extensible housing and allow raising of the inner portion to define an extended condition of this extensible housing. This housing portion, and the portions of the assembly above it, are raised a predetermined distance (precalculated to allow downward movement of this assembly due to expansion of the string of production tubing) and the lower end of the inner tubing is raised a corresponding distance from the lower end of the packer. The method provides a suspended assembly which provides a first inner production passage, extending to the lower end of the packer in its lowermost operative position, and an outer injection passage communicating with the annulus between the string of production tubing and the casing, at the lower end of the tubing string, and extending to the lower end of the production passage. The second or injection passage is defined by all or part of the twin flow means and the annulus defined by the inner tubing and outer tubing defined by the housing of the twin flow means, the extensible housing, the joint means, and the packer.

The method further involves the control of the flow of injection fluid into the upper end of the injection passage by means of a valve which effects the flow of injection fluid from the annulus into the injection passage, when the pressure of the fluid in the annulus, as determined by the hydrostatic head in addition to the injection pressure applied at the wellhead, exceeds the back pressure in the injection passage by a predetermined amount. This valve further controls the flow by preventing the excessive and wasteful flow of injection fluid into the injection passage when the back pressure drops to an abnormally low value.

This method enables the injection of injection fluid to the lowest possible point in the well, which point moves with the expansion and contraction of the string of production tubing responsive to the temperature of the production fluid. When that temperature is maximum, and the resultant expansion of the tubing string is maximum, the lower end of the inner tubing of the injection assembly will be very close to the lower end of the packer and accordingly as close as possible to the producing zone.

EMBODIMENTS OF FIGS. 7, 8, AND 9

FIGS. 7, 8, and 9 of the drawing are fragmentary diagrammatic views which, when considered together with FIG. 1, illustrate modified forms of apparatus according to the invention. Each of these FIGS. 7, 8, and 9 show the upper end of the twin-flow head 30 illustrated in FIG. 1; and each of these Figures, then, illustrate a modified assembly which includes the assembly of FIG. 1 from the twin-flow head 30 to the bottom of the well and including different components above the twin-flow head.

Referring particularly to FIG. 7, this illustrated assembly differs from that of FIG. 1 in that it does not include a side pocket mandrel 20 and its associated injection valve 90. The twin-flow head 30 is suspended directly from the production tubing string 15; and an injection valve 190 is secured in the upper end of the injection passage 33 of the twin-flow head. This injection valve 190 may be secured within the injection passage in any suitable manner, such as by mating threads. The operational structure of the injection valve 190 may be identical to that of the valve 90 illustrated in FIG. 4 including a side opening inlet passageway corresponding to the passageway 93 of FIG. 4. The injection valve 190, then, would serve to control the flow of injection fluid from the annulus 16 into the injection passage 33 in a manner identical to that of the injection valve 90.

Referring now particularly to FIG. 8, this illustrated assembly differs from that of FIG. 1 again in the omission of the side pocket mandrel 20 and its associated injection valve 90. In this assembly, the twin-flow head 30 is again suspended directly from the production tubing string 15. For controlling the flow of injection fluid from the annulus 16 into the injection passage 33, a choke 101 is secured in the upper end of the passage in any suitable manner; and this choke, by means of a restricted flow passage of selected size, limits the amount of fluid flowing into the injection passage, which flow is being forced by the volume of fluid in the annulus 16 and, possibly, additional pressure applied at the wellhead.

Referring now particularly to FIG. 9, this illustrated assembly differs from that of FIG. 1, again, in the elimination of the side pocket mandrel 20 and the injection valve 90. In this assembly the twin flow head is again suspended directly from the production tubing string 15; and the flow of injection flow to the injection passage 33 is accomplished by means of a second string of smaller tubing 128 which extends from the wellhead to the twin flow head 30. For this assembly, the control of the volume flow of injection fluid would be accomplished at the wellhead by any suitable means.

OPERATION, FEATURES AND ADVANTAGES

While the operation has been described to some extent in connection with the above described method, there will now be briefly described the assembly, installation, operation and partial removal of the apparatus of the invention, with reference to the specific components thereof which are illustrated in FIGS. 3-A through 3-G. One preliminary calculation which must be made is to determine the distance that the lower end of the production string will move due to expansion of the production string from the heated production fluid. This will depend of course on the depth of the well and the maximum temperature of the production fluid. This movement may be as much as fifteen to twenty feet in a deep well for example; and the seal bore converter 50 must be made up to a length to accommodate that movement between its fully retracted condition and its maximum extended condition while maintaining the sealing relation between the telescoping parts. When so made up the shear pins 57 are placed to maintain the retracted condition during the lowering of the assembly into the well. The housing 62 of the latching and sealing joint 60 is joined to the upper end of the packer, and the packer is then set in the well casing adjacent to the producing zone.

The portion of the assembly to be lowered into the well with the production tubing is then made up; and this includes the side pocket mandrel 20 with the valve 90 in place, the twin flow head 30, the twin flow converter 40, and the remaining portion of the latching and sealing joint 60. This assembly further includes the length of inner tubing 45 suspended from the twin flow converter and having a length calculated to extend to the bottom of the packer when this assembly is initially joined with the packer within the well.

When this assembly approaches the packer, the seal mandrel 63 of the latching and sealing joint will enter the housing 62 to effect the latching and sealing of these joint parts in the manner which has been described. The assembly is then in the condition illustrated in FIGS. 1 and 3-A through 3-G of the drawing. The tubing string is then raised a predetermined distance, fifteen feet for example; and since the seal bore converter housing 51 is now axially joined to the packer, the seal mandrel 52 will be raised, shearing the shear pins 57, and thereafter allowing relative axial movement of the housing and seal mandrel. The suspension of this production string is then fixed at the wellhead, and the assembly is then tested for leaks, and is then ready for production.

This assembly has been designed for facile removal of most of the assembly components, for the purpose of replacement or repair such as replacement of the seals in the seal bore converter. Removal of the major portion of the assembly is effected simply by withdrawing the string of production tubing from the well; and this will withdraw the entire suspended portion of the assembly down to and including the seal mandrel 52 of the seal bore converter and the tubing 45 which is suspended from the twin flow converter 40. An additional portion of the assembly including the seal housing 51 of the seal bore converter, the top sub 61, and the seal mandrel 63 and associated parts of the latching and sealing joint 60 may then be removed by engaging a suitable latching and rotating tool with the J-slot 59 at the upper end of the converter housing 51. Right hand rotation of this assembly will effect the unthreading of the left hand threads 65 and 72 of the latching and sealing joint. The removed portions of the assembly may then be reassembled in the manner described.

A principal feature and advantage of the apparatus and method of the invention is that it enables the injection of well treating chemicals, for example, to the lowest possible point adjacent to the producing zone, as determined by the expansion of the production tubing.

A more particular feature and advantage of the invention is that it enables the lower end of the production passage, as provided by the inner tubing 45, to extend within the packer, and thereby provide the lower end of the injection passage at that point, defined by the annulus between the inner tubing and packer, with this assembly accommodating inner tubing of the largest possible size to enable maximum production through the assembly.

A particular feature of the apparatus is the use of an oversized seal bore converter between the twin flow conversion components and the packer to again enable the use of the largest possible size of inner production tubing for maximum production, while at the same time providing the annular injection passage outside of this inner tubing and accommodating the expansion of the production string due to heat.

Another advantage of the full bore of the production tubing is that it permits the passage of well tools and devices therethrough for flow control, perforating, remedial work, sand removal, and like operations.

Still another important feature of the apparatus is the design which enables facile removal of the major portions of the assembly above the packer for the purpose of either replacement of parts, or repair of parts such as the seals in the seal bore converter 50 and the latching and sealing joint 60.

While preferred embodiments of the invention have been illustrated and described, it will be understood by those skilled in the art that changes and modifications may be resorted to without departing from the spirit and scope of the invention.

What is claimed is:

1. For use in injecting fluids into a well which includes a casing and a string of large capacity production tubing, an assembly comprising a packer to be set in said casing adjacent to the well producing zone, said packer having a large bore;

twin flow means to be joined to the lower end of said string of production tubing; said twin flow means providing, side-by-side, a first large capacity passage communicating with said production tubing and a second small capacity passage opening from the upper end of said twin flow means; said twin flow means including, at its lower end, an inner large capacity tubing and an enclosed outer tubular housing; said inner tubing defining a continuation of said first passage, and the annulus between said outer housing and said inner tubing defining a continuation of said second passage;

an extensible, large bore, tubular housing means joined at its upper end to said outer housing of said twin flow means;

means for joining the lower end of said extensible tubular housing means to the upper end of said packer;

a length of large capacity inner tubing joined to said inner tubing of said twin flow means; said length of inner tubing being of a length to extend into said packer adjacent to the lower end thereof, when said extensible housing means is in its retracted condition;

said large capacity inner tubing defining an extension of said first large capacity passage for passing fluid from the producing zone; and the annulus between said inner tubing and the enclosing structure defining an extension of said second small capacity passage to pass injection fluid to the lower end of said inner tubing.

2. An assembly as set forth in claim 1 a second string of small capacity tubing communicating with said second passage of said twin flow means and extending to the wellhead, for flowing injection fluid to the remainder of said assembly.

3. An assembly as set forth in claim 1 said second passage opening to the annulus between said casing and said string of production tubing.

4. An assembly as set forth in claim 3 control means disposed at the upper end of said second passage for controlling the flow of fluid from the annulus between said casing and said string of production tubing into said second passage.

5. An assembly as set forth in claim 4 said control means comprising a choke having flow restricting means.

6. An assembly as set forth in claim 4 said control means comprising a control valve responsive to the pressure differential between said annulus and said second passage.

7. An assembly as set forth in claim 6 said control valve having means to prevent fluid flow, when the pressure in said second passage drops to a preselected low value.

8. An assembly as set forth in claim 1 said twin flow means further comprising a side pocket mandrel to be joined to the lower end of said production tubing, providing a first main large capacity passage for communication with said production tubing and a side pocket receptacle; said receptacle having an inlet port opening to the exterior of said mandrel and an outlet port with associated small capacity conduit means, providing a second passage;

said twin flow head being joined to said side pocket mandrel, with said respective first large capacity passages communicating with each other and with said respective second small capacity passages communicating with each other.

9. An assembly as set forth in claim 8 a control valve disposed in said receptacle for controlling the flow of fluid from the annulus between said side pocket mandrel and said casing into said second passage, in response to the pressure differential between said annulus and said second passage.

10. An assembly as set forth in claim 8 said control valve having means to prevent fluid flow, when the pressure in said second passage drops to a preselected low value.

11. An assembly as set forth in claim 1 said extensible housing means comprising a telescoping housing, including an outer housing having a polished bore, and including an inner seal mandrel carrying annular seals coacting with said polished bore; said telescoping housing being extensible from a fully retracted position to a completely separated condition, and including releasable means for retaining said outer housing and mandrel in said fully retracted condition.

12. An assembly as set forth in claim 1 a landing nipple joined to the lower end of said packer, adapted for landing a plug to seal the production passage into said packer.

13. A method for providing production and injection passages in a producing wall having a casing and a string of large capacity production tubing, wherein the injection passage extends to a point very close to the producing zone of the well; including the steps setting, in the casing, a packer having an internal passage of sufficient size to pass large capacity production tubing with an annular flow space therebetween;

suspending, from the lower end of said production tubing, an assembly including an upper twin flow means, a lower large bore extensible tubular housing means joined to said twin flow means, for joining to said packer, and a length of large capacity inner tubing;

providing, side-by-side, in said twin flow means, a first large capacity passage communicating with said string of production tubing and a second small capacity passage communicating with the annulus between said casing and said string of production tubing, with the lower end of said first passage terminating in a large capacity inner tubing and the lower end of said second passage terminating in the annulus between said inner tubing and an outer housing;

joining the upper end of said extensible housing means to said outer housing of said twin flow means;

providing said extensible housing means with releasable means for maintaining said housing in a retracted condition;

suspending said length of large capacity inner tubing from said inner tubing of said twin flow means to extend through said extensible housing means, and said packer to a point adjacent to the bottom thereof, when said extensible housing is in said retracted condition;

whereby said inner tubing provides an extension of said first large capacity passage for passing production fluid from the producing zone; and whereby the annulus between said inner tubing and the enclosing structure provides an extension of said second passage for passing injection fluid from the annulus between said casing and said string of production tubing to the lower end of said inner tubing.

14. A method as set forth in claim 13 including the step providing a second string of small capacity tubing communicating with said second passage of said twin flow means and extending to the wellhead, for flowing injection fluid from the wellhead.

15. A method as set forth in claim 13 including the step controlling the flow of fluid from said casing annulus into said second passage by flow control means disposed at the upper end of said second passage.

16. A method as set forth in claim 13 including the step controlling the flow of fluid from said casing annulus into said second passage by a flow restricting choke means disposed at the upper end of said second passage.

17. A method as set forth in claim 13 including the step controlling the flow of fluid from said annulus into said second passage by valve means responsive to the pressure differential between said annulus and said second passage.

18. A method as set forth in claim 17 including the step further controlling the flow of fluid into said second passage by valve means which closes the inlet to said second passage, in response to a preselected low value of pressure in said second passage.

19. A method as set forth in claim 13 including the step providing in said twin flow means a twin flow head wherein said first and second passages are side-by-side, and a twin flow converter including said inner tubing providing an extension of said first passage and including said outer housing providing an extension of said second passage of said head; said converter converting said first and second passages from side-by-side passages to respective inner and surrounding annular passages.

20. A method as set forth in claim 13 including the step providing in said twin flow means a side pocket mandrel having a main large capacity passage defining the upper end of said first passage and having a receptable and an inlet port to said receptable from the exterior of said mandrel, defining the upper end of said small capacity second passage; and providing valve means in said receptacle for separating said second passage from the main passage of said side pocket mandrel and for controlling the flow of fluid into said second passage.

21. A method as set forth in claim 13 including the step providing, in said extensible housing, inner and outer telescoping housing members; and joining said housing members in a fully retracted condition by shear pins, separable in response to an axially directed force of preselected magnitude.

22. For use in injecting fluids into a well which includes a casing and a string of production tubing, an assembly comprising a packer to be set in said casing adjacent to the well producing zone;

twin flow means to be joined to the lower end of said string of production tubing; said twin flow means providing a first passage communicating with said production tubing and a second passage opening from the upper end of said twin flow means; said twin flow means including, at its lower end, an inner tubing and an enclosing outer tubular housing; said inner tubing defining a continuation of said first passage, and the annulus between said outer housing and said inner tubing defining a continuation of said second passage;

an extensible tubular housing means joined at its upper end to said outer housing of said twin flow means; said extensible housing means comprising a telescoping housing, including an outer housing having a polished bore, and including an inner seal mandrel carrying annular seals coacting with said polished bore; said telescoping housing being extensible from a fully retracted position to a completely separated condition, and including releasable means for retaining said outer housing and mandrel in said fully retracted condition; said seal mandrel of said telescoping housing being joined to said outer housing of said twin flow means;

joint means for joining the lower end of said extensible tubular housing means to the upper end of said packer;

a length of inner tubing joined to said inner tubing of said twin flow means; said length of inner tubing being of a length to extend into said packer adjacent to the lower end thereof, when said extensible housing means is in its retracted condition;

said inner tubing defining an extension of said first passage for passing fluid from the producing zone; and the annulus between said inner tubing and the enclosing structure defining an extension of said second passage to pass injection fluid to the lower end of said inner tubing.

23. For use in injecting fluids into a well which includes a casing and a string of production tubing, an assembly comprising a packer to be set in said casing adjacent to the well producing zone;

twin flow means to be joined to the lower end of said string of production tubing; said twin flow means providing a first passage communicating with said production tubing and a second passage opening from the upper end of said twin flow means; said twin flow means including, at its lower end, an inner tubing and an enclosing outer tubular housing; said inner tubing defining a continuation of said first passage, and the annulus between said outer housing and said inner tubing defining a continuation of said second passage;

an extensible tubular housing means joined at its upper end to said outer housing of said twin flow means;

joint means for joining the lower end of said extensible tubular housing means to the upper end of said packer; said joint means comprising an outer seal housing joined to said packer, and an inner seal mandrel joined to said extensible housing means; said seal mandrel carrying seals for sealing coaction with said outer seal housing; and said outer seal housing and said inner seal mandrel having coacting means for effecting axial latching thereof, when said seal mandrel is received in sealing relation in said housing;

a length of inner tubing joined to said inner tubing of said twin flow means; said length of inner tubing being of a length to extend into said packer adjacent to the lower end thereof, when said extensible housing means is in its retracted condition;

said inner tubing defining an extension of said first passage for passing fluid from the producing zone; and the annulus between said inner tubing and the enclosing structure defining an extension of said second passage to pass injection fluid to the lower end of said inner tubing.

24. An assembly as set forth in claim 23 said seal housing of said joint means having internal threads adjacent to its upper end;

said mandrel of said joint means being provided with circumferentially spaced axially extending flexible fingers, having serrations at the distal ends thereof which define external threads for coaction with the internal threads of said seal housing; and said coacting threads enabling engagement thereof by axial ratcheting, and enabling disengagement thereof by rotation of said seal mandrel relative to said seal housing.

25. A method for providing production and injection passages in a producing well having a casing and a string of production tubing, wherein the injection passage extends to a point very close to the producing zone of the well; including the steps setting, in the casing, a packer having an internal passage of sufficient size to pass production tubing with an annular flow space therebetween;

suspending, from the lower end of said production tubing, an assembly including an upper twin flow means, a lower extensible tubular housing means joined to said twin flow means, joint means for joining the lower end of said extensible housing means to said packer, and a length of inner tubing;

providing, in said twin flow means, a first passage communicating with said string of production tubing and a second passage communicating with the annulus between said casing and said string of production tubing, with the lower end of said first passage terminating in an inner tubing and the lower end of said second passage terminating in the annulus between said inner tubing and an outer housing;

providing said extensible housing means with releasable means for maintaining said housing in a retracted condition, joined to said twin flow means outer housing;

suspending said length of inner tubing from said inner tubing of said twin flow means to extend through said extensible housing means, said joint means, and said packer to a point adjacent to the bottom thereof, when said extensible housing is in said retracted condition;

after joining said assembly to said packer by means of said joint means, raising said production tubing and said twin flow means a selected distance relative to said packer, whereby said releasable means of said extensible housing means is released, thereby effecting the extension of said extensible housing means and the raising of the lower end of said inner tubing from the bottom of said packer, to thereby accommodate subsequent lowering of the raised members due to expansion of the string of production tubing resulting from the heating of that tubing;

whereby said inner tubing provides an extension of said first passage for passing production fluid from the producing zone; and whereby the annulus between said inner tubing and the enclosing structure provides an extension of said second passage for passing injection fluid from the annulus between said casing and said string of production tubing to the lower end of said inner tubing.

26. A method for providing production and injection passages in a producing well having a casing and a string of production tubing, wherein the injection passage extends to a point very close to the producing zone of the well; including the steps setting, in the casing, a packer having an internal passage of sufficient size to pass production tubing with an annular flow space therebetween;

suspending, from the lower end of said production tubing, an assembly including an upper twin flow means, a lower extensible tubular housing means joined to said twin flow means, joint means for joining the lower end of said extensible housing means to said packer, and a length of inner tubing;

providing, in said twin flow means, a first passage communicating with said string of production tubing and a second passage communicating with the annulus between said casing and said string of production tubing, with the lower end of said first passage terminating in an inner tubing and the lower end of said second passage terminating in the annulus between said inner tubing and an outer housing;

providing said extensible housing means with releasable means for maintaining said housing in a retracted condition, joined to said twin flow means outer housing;

providing in said joint means inner and outer telescoping housings having coacting seal means, and having coacting latch means engageable upon relative axial movement of said housings into sealing relation;

suspending said length of inner tubing from said inner tubing of said twin flow means to extend through said extensible housing means, said joint means, and said packer to a point adjacent to the bottom thereof, when said extensible housing is in said retracted condition;

whereby said inner tubing provides an extension of said first passage for passing production fluid from the producing zone; and whereby the annulus between said inner tubing and the enclosing structure provides an extension of said second passage for passing injection fluid from the annulus between said casing and said string of production tubing to the lower end of said inner tubing.

27. A method as set forth in claim 26 including the steps providing in said joint means coacting thread means, including internal threads in said outer housing and external threads provided at the distal ends of circumferentially separated axially extending flexible fingers, whereby said coacting threads are engageable by ratcheting of said flexible fingers relative to said internal threads, and wherein said coacting threads are disengageable only through relative rotation thereof.

* * * * *